US007111473B2

(12) United States Patent
Chung et al.

(10) Patent No.: US 7,111,473 B2
(45) Date of Patent: Sep. 26, 2006

(54) ICE BANK OF ICE-MAKING DEVICE FOR REFRIGERATOR

(75) Inventors: Eui Yeop Chung, Seoul (KR); Wook Yong Lee, Gwangmyeong-si (KR); Seung Hwan Oh, Seoul (KR); Myung Ryul Lee, Seongnam-si (KR)

(73) Assignee: LG Electronics Inc, Seoul (KR)

( * ) Notice: Subject to any disclaimer, the term of this patent is extended or adjusted under 35 U.S.C. 154(b) by 0 days.

(21) Appl. No.: 10/834,178

(22) Filed: Apr. 29, 2004

(65) Prior Publication Data

US 2004/0261442 A1 Dec. 30, 2004

(30) Foreign Application Priority Data

Jun. 25, 2003 (KR) ..... 10-2003-0041562
Sep. 19, 2003 (KR) ..... 10-2003-0065160

(51) Int. Cl.
*F25C 5/04* (2006.01)

(52) U.S. Cl. ..... 62/320; 62/346; 241/DIG. 17

(58) Field of Classification Search ..... 62/320, 62/346; 241/DIG. 17
See application file for complete search history.

(56) References Cited

U.S. PATENT DOCUMENTS 3,406,871 A 10/1968 Hoenisch
3,412,909 A 11/1968 Callen
3,796,351 A 3/1974 Kohl et al.
4,123,918 A 11/1978 Kohl et al.
4,176,527 A 12/1979 Linstrimberg et al.
4,276,750 A * 7/1981 Kawasumi ..... 62/137
4,942,979 A 7/1990 Ligstromberg et al.
5,050,777 A 9/1991 Buchser
5,056,688 A * 10/1991 Goetz et al. ..... 222/146.6
6,050,097 A 4/2000 Nelson et al.
6,082,130 A 7/2000 Pastryk et al.
6,148,624 A 11/2000 Bishop et al.
6,286,324 B1 9/2001 Pastryk et al.
6,314,745 B1 11/2001 Janke et al.
6,351,958 B1 3/2002 Pastryk et al.
6,557,355 B1 * 5/2003 Niechcial et al. ..... 62/74
6,904,765 B1 * 6/2005 Lee et al. ..... 62/320

FOREIGN PATENT DOCUMENTS

DE 19639475 4/1998

(Continued)

OTHER PUBLICATIONS

English Language Abstract of JP 3054102.

(Continued)

*Primary Examiner*—William E. Tapolcai
(74) *Attorney, Agent, or Firm*—Greenblum & Bernstein, P.L.C.

(57) ABSTRACT

An ice bank of an ice-making device for a refrigerator is disclosed, for smooth crush and discharge of ice, which includes a housing for storing ice made in an icemaker, and provided rotatably to apply the power to the stored ice at a rotation direction; an ice discharger having at least one hole through which the ice is discharge to the external; a crusher provided in the inside of the housing, the crusher guiding the stored ice to the hole of the ice discharge and crushing the ice as a predetermined size before discharging the ice to the hole according to a user's select; and rotating means for rotating the housing. Also, the crusher includes fixed crushing means fixed to the inside of the housing, and rotation crushing means rotated for being synchronized with the housing so as to crush the ice before discharging the ice to the external according to a user's select.

28 Claims, 10 Drawing Sheets

FOREIGN PATENT DOCUMENTS

| | | |
|---|---|---|
| FR | 2648338 | 12/1990 |
| JP | 59-041761 | 3/1984 |
| JP | 3054102 | 9/1998 |

OTHER PUBLICATIONS

English language Abstract of JP 59-41761.

* cited by examiner

ICE BANK OF ICE-MAKING DEVICE FOR REFRIGERATOR

This application claims the benefit of the Korean Applications No. P2003-41562, filed on Jun. 25, 2003 and No. P2003-65160 filed on Sep. 19, 2003, the disclosures of both of which are hereby incorporated by reference.

BACKGROUND OF THE INVENTION

1. Field of the Invention

The present invention relates to a refrigerator, and more particularly, to an ice bank of an ice-making device, having an improved structure for discharging ice smoothly.

2. Discussion of the Related Art

In general, a refrigerator is provided with a cooling chamber and a freezer. At this time, the cooling chamber keeps a temperature at about 3° C.–4° C. for keeping food and vegetables fresh for a long time, and the freezer keeps a temperature at a sub-zero temperature for keeping and storing food frozen for a long time.

Recently, the refrigerator has been developed for performing various additional functions besides a typical function thereof. For example, an icemaker may be provided in the refrigerator. FIG. 1 is a schematic view illustrating a general ice-making device for a refrigerator, and FIG. 2 is a schematic view illustrating a general icemaker of an ice-making device for a refrigerator. Referring to FIG. 1 and FIG. 2, the icemaker 1 is provided and fixed in an upper inside part of a freezer of the refrigerator. The icemaker 1 freezes up water and discharges ice automatically.

Hereinafter, the icemaker 1 is provided with an ice-making part 11 making ice, a water-supplying part 12 provided at one side of the ice-making part 11 so as to supply water to the ice-making part 11, a controller 13 provided at the other side of the ice-making part 11 and having a motor (not shown) therein, and an ejector 14 connected with the motor to discharge the ice made in the ice-making part 11 to an ice bank 5. Also, a connector 15 is provided at the rear side of the icemaker 1 to connect the icemaker 1 with the freezer of the refrigerator.

At this time, the ice-making part 11 is formed in a semi-cylindrical shape, and a plurality of ribs 16 are provided at fixed intervals so as to divide an interior space of the ice-making part 11 into sections. Then, the ejector 14 has a shaft crossing the center of the ice-making part 11, and a plurality of fins 14*a* are provided at a side portion of the shaft of the ejector 14 so as to discharge the made ice to the ice bank 5.

Also, a slide bar 17 is provided at a side of the fin 14*a* to guide the ice to the ice bank 5. More specifically, the ice guided by the fin 14*a* of the ejector 14 is dropped onto the slide bar 17, and then the ice slide along the surface of the slide bar 17 for being moved to the inside of the ice bank 5 provided at a lower part of the icemaker 1.

A heater (not shown) is provided on a lower surface of the ice-making part 11. In order to transfer the made ice, it is required to separate the ice from the surface of the ice-making part 11. For this, a temperature on the lower surface of the ice-making part 11 is increased with the heater, whereby the surface of the ice is melted, and the ice having the melted surface is smoothly transferred.

In a door 2 of the freezer for the refrigerator, there are the ice bank 5 and a dispenser 21 besides the icemaker 1. The ice bank 5 stores the ice made in the icemaker 1, and discharges the ice to the dispenser 21 at a user's need. At this time, the ice bank 5 is provided in a cylindrical shape having a hollow interior space, and the ice bank 5 is provided with a container for storing the ice, an ice transfer 3, and a crusher 4. The ice transfer 3 is means for transferring the stored ice to the dispenser 21, which is provided with a motor 31 and an auger 33. In this case, as the auger 33 is rotated according to the motor 31, the ice stored in an upper part of the ice bank 5 is moved to a lower part. Also, the crusher 4 is provided in the auger 33. In case the ice is made as a large-size piece, the piece of ice is crushed for being suitable to make cool drink and food with the ice.

However, the ice bank 5 having the aforementioned structure according to the related art has the following disadvantages.

First, the auger has a function for rotating the ice by the motor. If the dispenser is not used for a long time period, the ice may be caught and fixed in the auger, whereby it is impossible to move the ice smoothly, and the auger may be distorted. That is, the ice stored in the center of the container is moved smoothly. However, it is hard to move the ice stored in side portions of the container 21 with the auger 22. Accordingly, the driving motor 25 for driving the auger 22 may be damaged.

Furthermore, the driving motor 25 is provided in the lower part of the dispenser 30. Thus, it is required to provide an additional connection shaft 24 for transferring rotation power of the driving motor 25 to the auger 22, so that the structure of the inner wall of the door 2, in which the connection shaft 24 is provided, is complicated.

In order to overcome these problems, it is required to develop the ice bank of the ice-making device and the refrigerator using the same, having the structure to made the piece of ice in a size corresponding to a user's desire without changes and damages of the inside structure in the ice bank, to discharge the ice stored and fixed in the container smoothly.

SUMMARY OF THE INVENTION

Accordingly, the present invention is directed to an ice bank of an ice-making device for a refrigerator that substantially obviates one or more problems due to limitations and disadvantages of the related art.

An object of the present invention is to provide an ice bank of an ice-making device for a refrigerator, for smooth crush and discharge of ice.

Another object of the present invention is to provide an ice bank of an ice-making device for a refrigerator, to discharge crushed or uncrushed ice according to a user's select.

Another object of the present invention is to provide an ice bank of an ice-making device for a refrigerator, to occupy a small space.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an ice bank of an ice-making device includes a housing for storing ice made in an ice-maker, and provided rotatably to apply the power to the stored ice at a rotation direction; an ice discharger having at least one hole through which the ice is discharge to the external; a crusher provided in the inside of the housing, the crusher guiding the stored ice to the hole of the ice discharge and crushing the ice as a predetermined size before discharging the ice to the hole according to a user's select; and rotating means for rotating the housing.

At this time, the housing includes an open top positioned for being corresponding to a lower part of the icemaker to receive the ice made in the icemaker; and sliding prevention means applying the power to the ice stored in the inside of the housing during rotation of the housing for rotating the stored ice without sliding.

Also, the sliding prevention means comprises a plurality of projections formed on an upper inner wall of the housing.

Also, the ice discharger is formed of a base plate, the base plate provided as a bottom of the housing for not being rotated.

In case two or more holes are provided in the base plate, the uncrushed ice is discharged to the external through at least one of the holes.

At this time, the crusher includes a fixed part provided in the inside of the housing not to be rotated; and a rotating part guiding the ice to the ice discharger by being rotated to be synchronized with the housing and applying the power to the stored ice, and guiding the crushed ice to the ice discharger after crushing the ice with the fixed part at a user's need.

Also, the fixed part includes a fixed rod provided in the inside of the housing at an axis direction; and at least one fixed crushing means having one end connected with the fixed rod to crush the ice with the rotating part.

Also, the fixed rod has a lower end fixed to the ice discharger.

The fixed part further includes guiding means being connected with the fixed rod so as to guide the stored ice to the fixed crushing means as the housing rotates to discharge the stored ice.

The guiding means includes a fixed plate through which the stored ice passes, the fixed plate being provided between the open top of the housing and the fixed crushing means.

The fixed plate includes an ice-moving hole provided at the portion not to be corresponding to the hole of the ice discharger, so as to prevent the ice from dropping on the hole of the ice discharger directly.

The guiding means further includes separating means provided in the upper part of the fixed plate, the separating means separating the ice pieces to have the size suitable for the ice passing through the fixed plate by applying the power to the ice pieces being rotated with the housing in case the ice pieces are stuck and fixed.

The separating means includes at least one arm having one end connected with the fixed rod, and the other end extending toward the inner wall of the housing.

The separating means includes at least one part curved from the fixed rod toward the inner wall of the housing.

The fixed crushing means includes a fixed cutter having one end connected with the fixed rod, the other end extending toward the inner wall of the housing to avoid the interference with the rotating part, and at least one side formed as a cutting edge.

The fixed cutter is provided at one side above the hole of the ice discharger for crushing the ice before the ice approaches the hole of the ice discharger by rotation of the rotating part in case a user selects a mode of discharging the crushed ice.

The fixed cutter is provided between the holes of the ice discharge in case two or more holes are provided in the ice discharger.

The rotating part includes rotation crushing means supported by the inner wall of the housing to avoid the interference with the fixed crushing means.

The rotation crushing means includes one or more rotating cutters each having at least one side formed as a cutting edge.

Preferably, the rotating cutter is provided to cross the inner space of the housing.

Preferably, a central part of the rotating cutter is rotatably connected with the fixed rod.

Meanwhile, the rotating part includes at least one rotating arm provided at a direction to cross an upper part of the fixed plate, and rotated for being synchronized with the housing.

The rotating means is formed to rotate the housing with a belt driven by a driving motor.

The rotating means is formed to rotate the housing with a gear train rotated by a driving motor.

Also, the rotating means is formed to rotate the housing with a chain driven by a driving motor.

In the aforementioned ice bank of the ice-making device, it is possible for a user to selectively obtain the crushed ice or the uncrushed ice, and to discharge the ice smoothly.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

In general, an ice-making device makes ice pieces having a predetermined size by freezing water, and discharges the ice pieces to the external at a user's need. Also, the ice-making device supplies uncrushed ice or crushed ice according to a user's select. The ice-making device is usually provided in a refrigerator. However, it is possible to provide the ice-making device in a device for drinking, such as a water purifier.

Hereinafter, an ice bank of an ice-making device according to the preferred embodiments of the present invention will be described with reference to FIG. 3 to FIG. 10.

Figure 1:
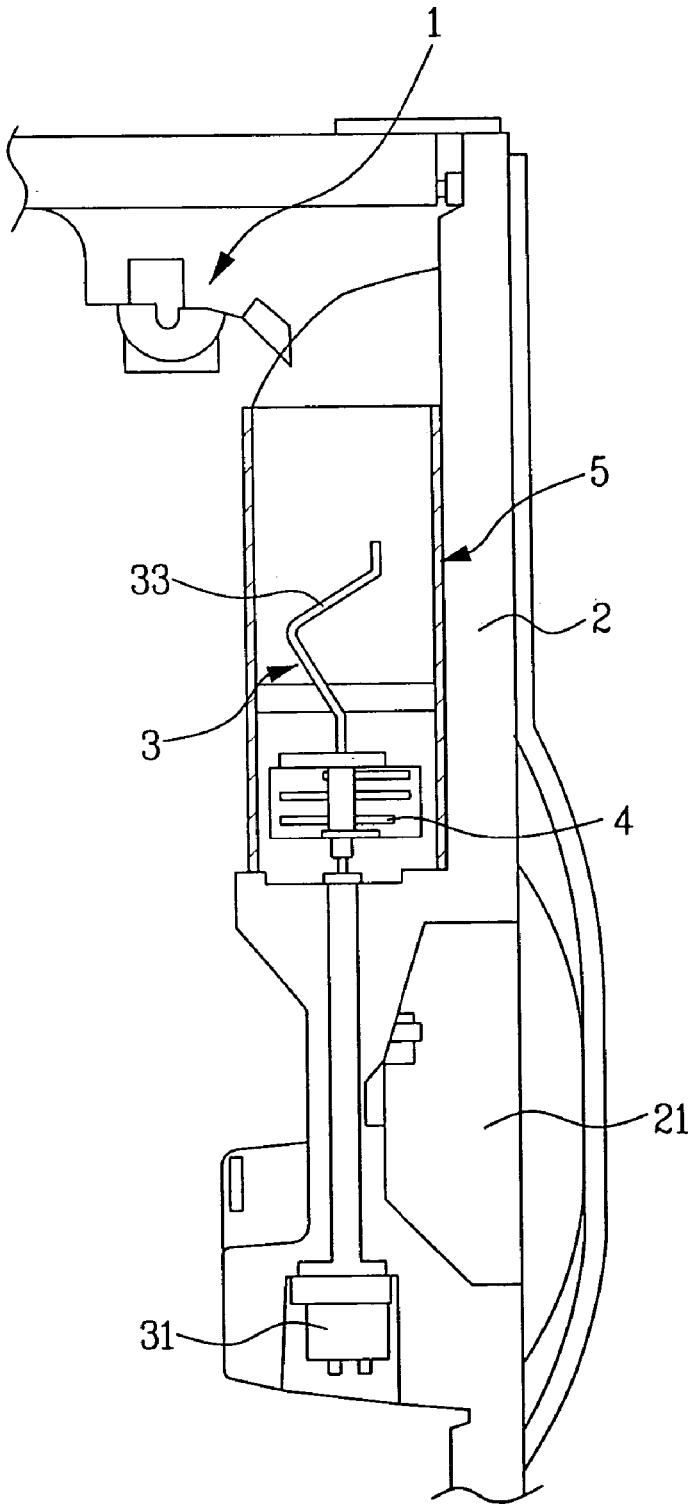
FIG. 1 is a schematic view illustrating a general ice-making device for a refrigerator.
Figure 2:
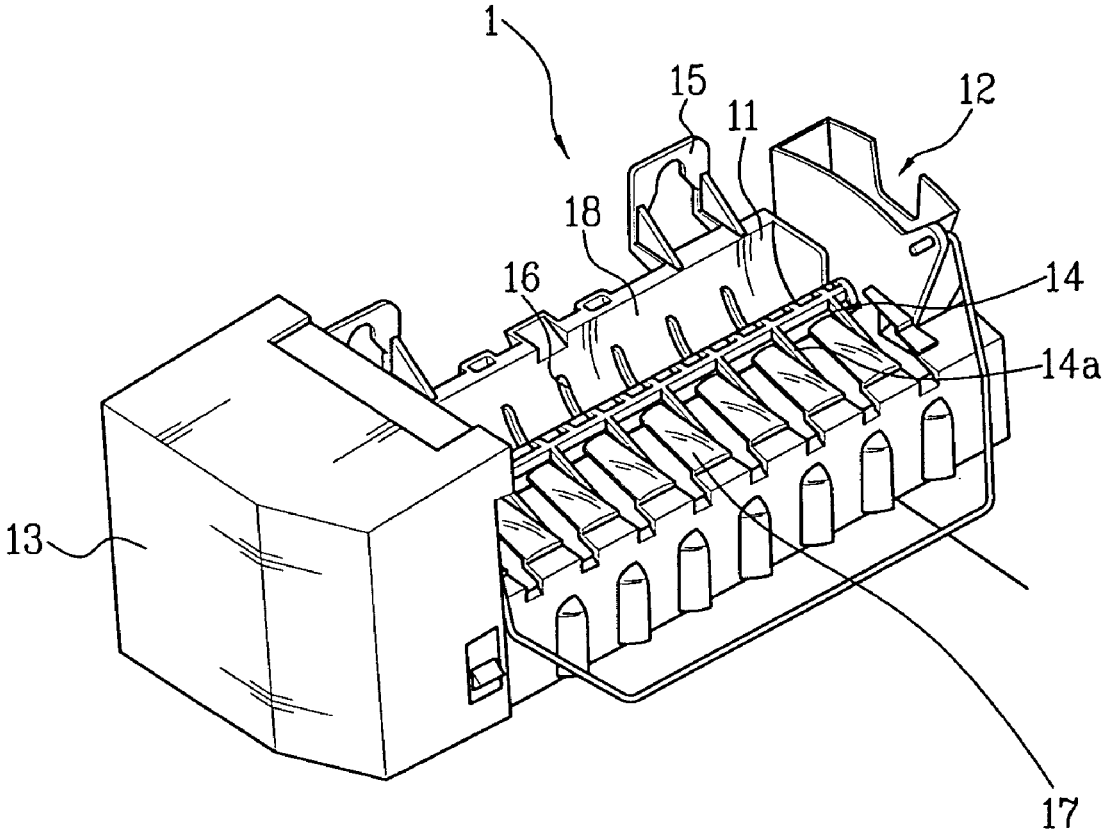
FIG. 2 is a schematic view illustrating an icemaker of a general ice-making device for a refrigerator.
Figure 3:
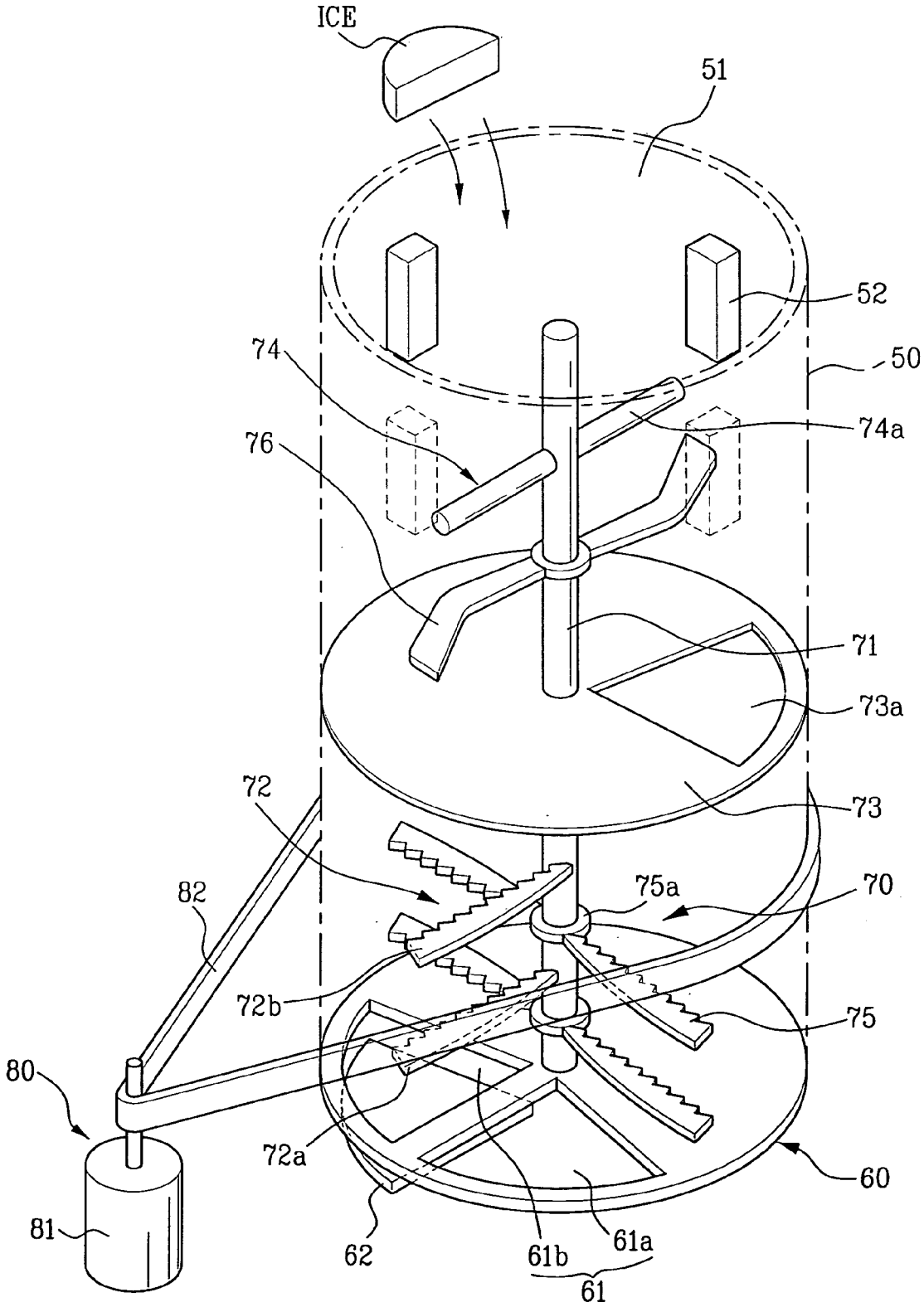
FIG. 3 is a schematic view illustrating an ice bank of an ice-making device according to the first embodiment of the present invention.

Referring to FIG. 3, an ice bank according to the first embodiment of the present invention includes a housing 50, an ice discharger 60, a crusher 70, and rotating means 80. At this time, the housing 50 for storing ice made in an icemaker (not shown) is provided rotatably, and the ice discharger 60 provides an outlet through which the ice is discharged to the external. Also, the crusher 70 is provided in the inside of the housing 50, and the rotating means 80 is provided to rotate the housing 50.

In case the ice-making device is provided in the refrigerator, it is preferable to provide the ice bank in the inside of a door of a freezer for the refrigerator. Also, the housing 50 is provided at a lower part of the icemaker, and the housing 50 has an open top 51, whereby the ice made in the icemaker is provided to the housing 50 through the open top 51. When discharging the stored ice to the external, the housing 50 applies rotation power to the stored ice at a rotation direction, so that the ice is rotated in the housing 50 at the same direction.

For this, the housing 50 further includes sliding prevention means 52 for smooth rotation of the stored ice. Preferably, the sliding prevention means 52 are provided on an inner wall of the housing 50, and more particularly, on an upper side of the inner wall of the housing 50. In this case, the sliding prevention means 52 may be provided of a plurality of projections, each projection may be provided in a longitudinal direction for being integrated with the housing 50. Also, the projections are provided to divide the inner wall of the housing 50 into sections, and it is preferable to form each projection having a rectangular or triangular cross-section. At this time, the housing 50 may be formed of various shaped cross-sections. However, it is preferable to form the cross-section of the housing 50 in a cylindrical shape so that the ice stored in the housing 50 is smoothly rotated, simultaneously, an occupying space for the housing 50 is decreased.

The ice discharger 60 provided in a lower part of the housing 50 forms the bottom of the cylindrical housing 50, and the ice discharger 60 is immovable without rotation according to the housing 50. Preferably, a bearing (not shown) is provided between the lower part of the housing 50 and the ice discharger 60, for smooth rotation of the housing 50. The ice discharger 60 is formed of a base plate provided in a lower surface of the housing 50, and the base plate includes at least one hole 61 having a predetermined size suitable to discharge the ice from the crusher 70.

In case the base plate includes two or more holes 61*a* and 61*b*, it is preferable to provide at least any one 61*a* through which the crushed ice having the predetermined size or less is discharged. In this case, it is preferable to close the other 61*b*, through which the uncrushed ice is discharged, with a damper 62. In the ice bank of the ice-making device according to the preferred embodiment of the present invention, the ice discharger 60 has the two holes, one 61*a* for discharging the crushed ice, and the other 61*b* for discharging the uncrushed ice.

Meanwhile, the crusher 70 guides the stored ice to the ice discharger 60, and crushes the ice to have the predetermined size according to a user's select, before discharging the ice to the ice discharger 60. That is, generally, the uncrushed ice is discharged through the ice discharger 60. However, in case the user selects a mode for crushing the ice, the stored ice is crushed by the crusher 70, and then is discharged through the ice discharger 60.

For this, it is preferable to provide the crusher 70 having a fixed part and a rotating part. At this time, the fixed part provided in the inside of the housing 50 is not rotated. Also, the rotating part is rotated for being synchronized with the housing 50 so that the rotating part applies rotation power to the stored ice. Thus, the ice is rotated and guided to the ice discharger 60. At this time, in case the user selects the mode for crushing the ice, the rotating part crushes the ice with the fixed part, and guides the crushed ice to the ice discharger.

In more detail, the fixed part is provided with a fixed rod 71 and at least one fixed crushing means 72. At this time, the fixed rod 71 is provided in the inside of the housing 50 in an axis direction, and the fixed crushing means 72 has one end connected with the fixed rod 71 to crush the ice with the rotating part. Preferably, the fixed rod 71 has a lower end fixed to the ice discharger 60.

Also, the fixed crushing means 72 has one end fixed to the fixed rod 71, whereby the fixed crushing means 72 crushes the ice by applying shearing power to the ice at opposite directions when the ice guided by the rotating part approaches the fixed crushing means 72. Preferably, the fixed part further includes guiding means for guiding the stored ice to the fixed crushing means 72 as the housing 50 rotates during discharging the stored ice.

In this state, the guiding means is formed of a fixed plate 73, through which the stored ice passes, between the open top 51 of the housing and the fixed crushing means 72. The fixed plate 73 has an ice-moving hole 73*a* not to be corresponding to the hole 61 of the ice discharger 60, so that it is possible to prevent the ice from dropping on the hole 61 of the ice discharger 60 directly.

In the present invention, the ice-moving hole 73*a* is provided in an opposite side to the hole 61 of the ice discharger 60 with the standard fixed rod 71. Also, the fixed plate 73 having the ice-moving hole 73*a* divides the space of the housing 50 into upper and lower parts. That is, the ice made in the icemaker is firstly stored in the space formed by the housing 50 and the fixed plate 73. Then, as the housing 50 is rotated at a user's need, the stored ice is rotated. Accordingly, the ice is guided to the ice-moving hole 73*a* of the fixed plate 73, and then the ice is dropped on the lower part of the housing 50.

In addition, the guiding means may have separating means 74 for separating the ice pieces to have the size suitable for passing through the fixed plate 73 in case the ice pieces are stuck and fixed. When the ice pieces stuck and fixed are rotated with the housing 50, the ice pieces are separated by impact to a degree. However, it is preferable to provide the separating means 74 in the guiding means so as to improve efficiency on separating the ice pieces.

The separating means 74 may be formed of at least one arm 74*a* having one end connected with the fixed rod 71, and the other end extending toward the inner wall of the housing 50. Also, the separating means 74 may be formed of at least one part curved toward the inner wall of the housing 50. In this case, when the separating means 74 is provided, it is preferable to control the size of the separating means 74 not to carry the load on the rotating means 80, and to prevent the fixed rod 71 from being distorted.

Figure 4:
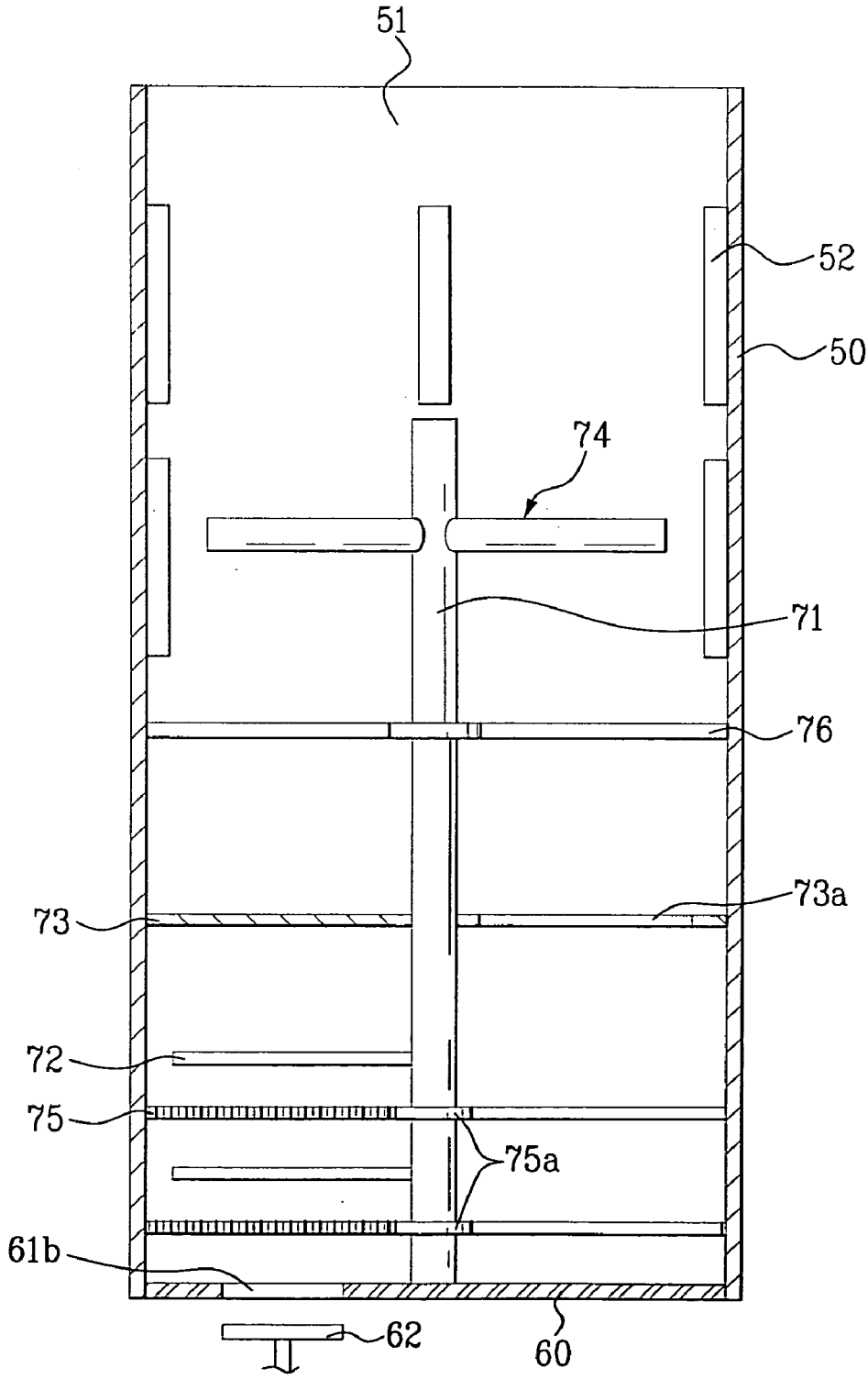
FIG. 4 is a cross-sectional view illustrating an ice bank according to the first embodiment of the present invention.
Figure 7:
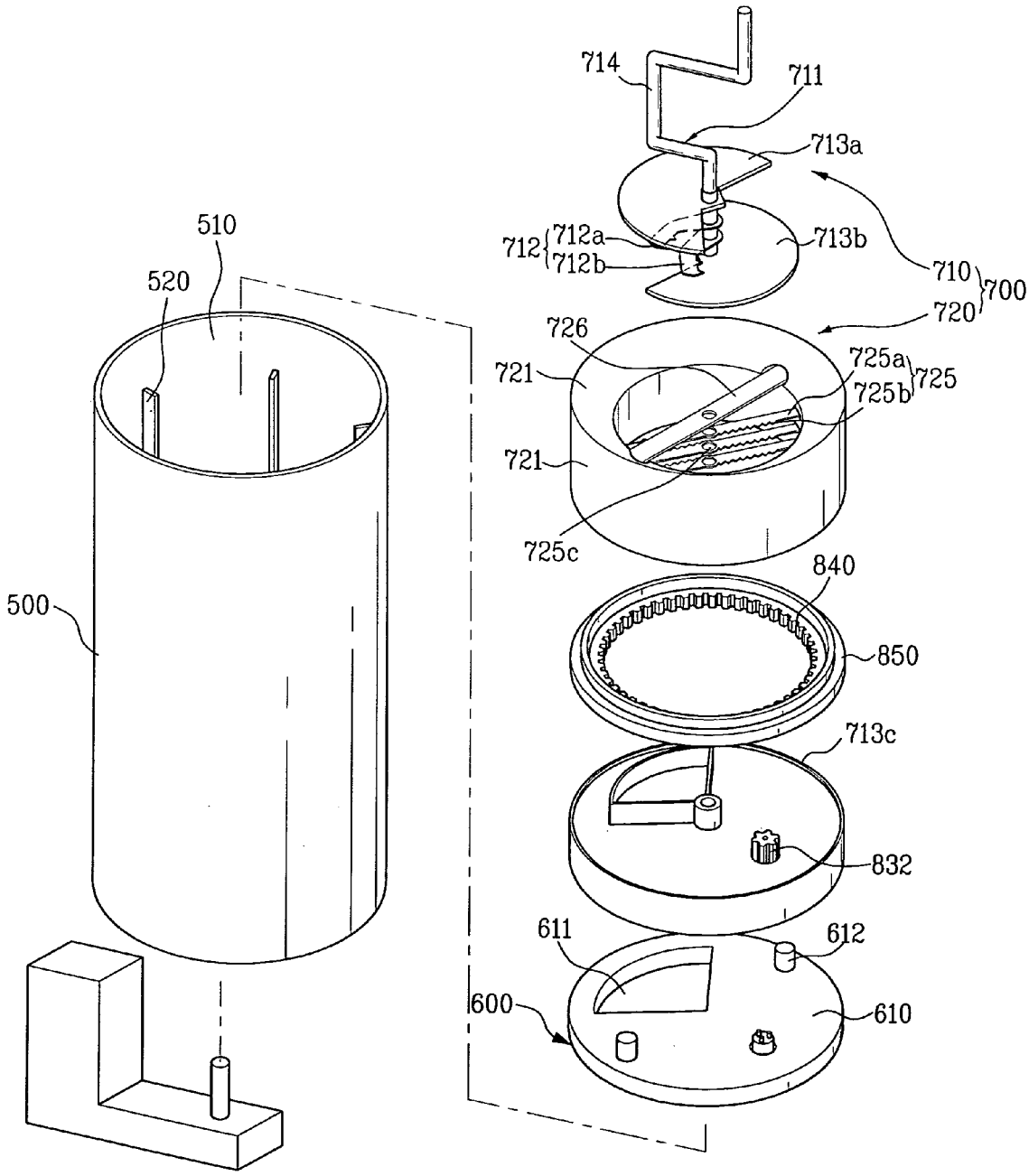
FIG. 7 is a schematic view illustrating an ice bank of an ice-making device according to the second embodiment of the present invention.
Figure 8:
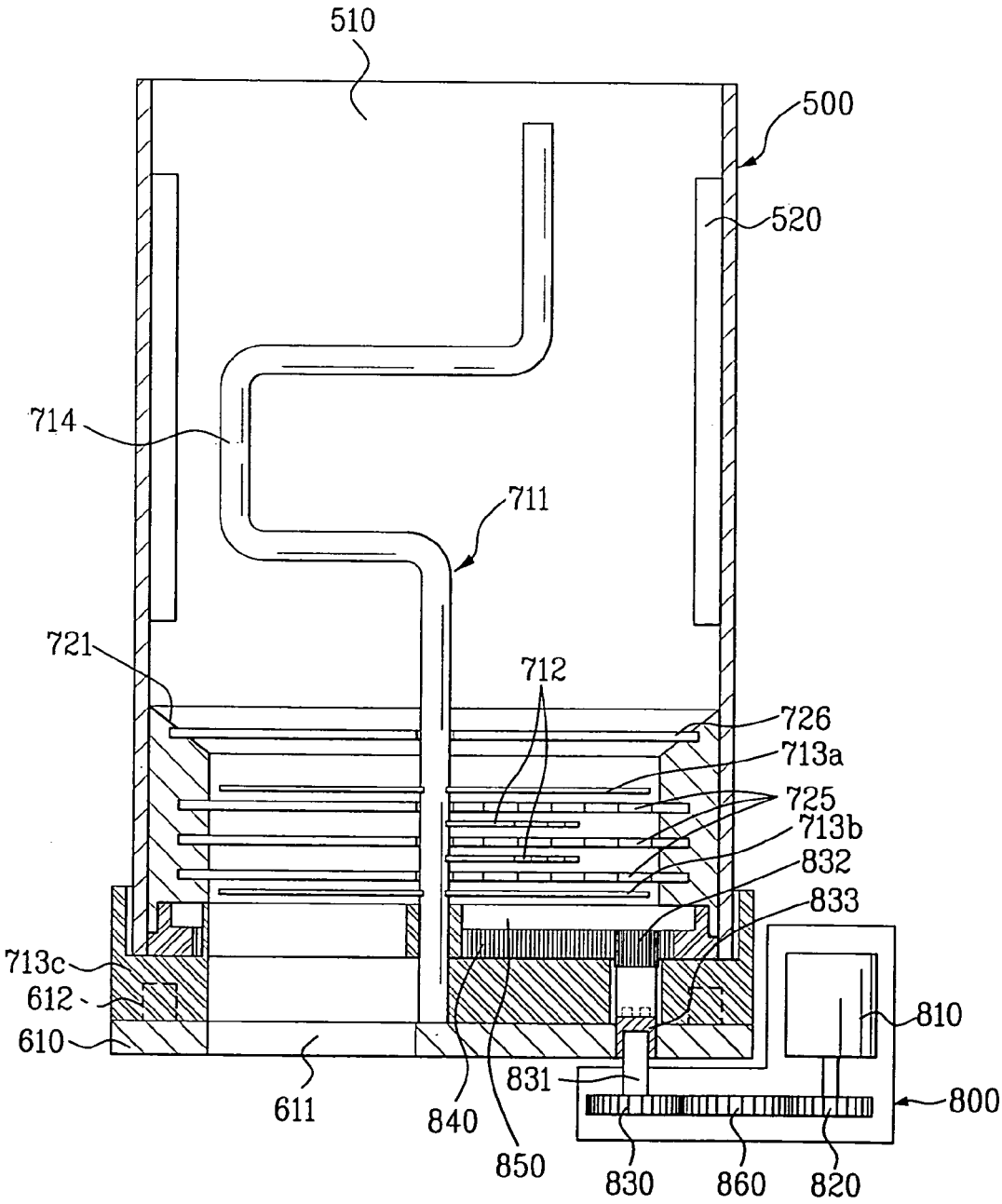
FIG. 8 is a cross-sectional view illustrating an ice bank according to the second embodiment of the present invention.

As shown in FIG. 3 and FIG. 4, the separating means 74 is formed of the arm according to the first embodiment of the present invention. Also, as shown in FIG. 7 and FIG. 8, the separating means 74 is formed of the curved part according to the second embodiment of the present invention. Although not shown, the separating means may be formed of a cutter.

In case the user selects the mode for crushing the ice, the fixed crushing means 72 crushes the ice before the ice approaches the hole 61 of the ice discharger 60 according to the rotation of the rotating part. For this, the fixed crushing means 72 is provided with a fixed cutter 72*a* having one end connected with the fixed rod, the other end extending toward the inner wall of the housing 50 to avoid the interference with the rotating part, and at least one side formed as a cutting edge.

The fixed cutter 72*a* is provided at one side above the hole 61 of the ice discharger 60. That is, in case the user selects the mode for crushing the ice, it is preferable to crush the ice pieces before the ice pieces approach the hole 61 of the ice discharger 60 by rotating the rotating part. For discharging the uncrushed ice, the rotating part 50 is rotated at the reverse direction, whereby the rotating part 50 passes by the fixed cutter 72*a* after the hole 61 of the ice discharger 60. Thus, the uncrushed ice is discharged to the external. In this case, it is required to rotate the rotating part 50 at both clockwise and counter-clockwise directions.

However, in case the two holes 61*a* and 61*b* are provided in the ice discharger 61 according to the preferred embodiment of the present invention, the fixed cutter is provided between the two holes 61*a* and 61*b* of the ice discharger 61. At this time, it is possible to provide the rotating part 50 being rotated at one direction. When there are the first hole 61*b* and the second hole 61*a*, the first hole 61*b* indicates the hole that the rotating part passes by before the fixed cutter. In case two or more fixed cutters 72*a* and 72*b* are provided, it is preferable to provide the fixed cutters 72*a* and 72*b* for being in parallel at fixed intervals.

Meanwhile, the rotating part is provided in the inner wall of the housing 50. More particularly, the rotating part is formed of one or more rotation crushing means supported by the inner wall of the housing 50. The rotation crushing means is formed of a rotating cutter 75 having at least one side formed as a cutting edge. At this time, both ends of the rotating cutter 75 are supported by two predetermined points of the inner wall of the housing 50, the two points having the farthest horizontal distance from each other. When the housing is formed in the cylindrical shape as shown in the preferred embodiment of the present invention, the rotating cutter is provided to cross a diameter direction of the housing 50. Also, a central part 75*a* of the rotating cutter is rotatably connected with the fixed rod 71.

In case the cutting edge is formed at one side of the rotating cutter, the cutting edges formed on opposite sides of the central part 75*a* are provided at different directions since the cutting edge is formed at a rotation direction of the rotating cutter. Preferably, the cutting edge of the rotating cutter is formed at the rotation direction, and the cutting edge of the fixed cutter 72*a* is provided for being opposite to the rotation direction. In case the two or more rotating cutters 75 are provided, it is preferable to provide the rotation cutters at fixed intervals. Preferably, for smoothly crushing the ice, the rotating cutters are provided for being in parallel. Meanwhile, the cutting edge of the rotating cutter is formed in a saw-tooth shape.

Although not shown, the rotating cutter has one end fixed to the inner wall of the housing 50, and the other end rotatably connected with the fixed rod. For example, if the housing is formed in the cylindrical shape, the rotating part is provided in the radius of the housing 50. The rotating part may be formed of one or more rotating cutters each having at least one side formed as the cutting edge. If the two or more rotating cutters are provided in the rotating part, it is preferable to provide the rotating cutters for being in parallel at fixed intervals.

The rotating means is provided to rotate the housing 50. Herein, the housing 50 may be rotated in various methods. In addition, the rotation crushing means is fixed to the inner wall of the housing 50, and the rotation crushing means may have a hollow-shaped supporter for supporting the rotating cutter. This structure will be described with reference to the second embodiment of the present invention.

Preferably, the rotating part includes at least one rotating arm 76 provided at a direction crossing an upper space of the fixed plate to avoid the interference with the separating means 74, and rotated for being synchronized with the housing 50. At this time, the rotating arm 76 is provided in the inner wall of the housing 50 or the inner wall of the hollow-shaped supporter to cross the upper space of the housing 50.

In the first embodiment of the present invention, the housing 50 is rotated with a belt 82. For this, the rotating means 80 is provided with a driving motor 81 driven by electric power, and the belt 82 wound around a rotation axis of the driving motor 81 and the outer wall of the housing 50. Although not shown, a groove (not shown) for the belt 82 is provided in the outer wall of the housing 50. Also, it is preferable to provide a ball bearing or a roller bearing between the ice discharger and the housing 50. At this time, the driving motor 81 is provided at the side of the housing 50 to occupy the small space for the ice-making device.

The rotating means 80 may be rotated with a chain (not shown) instead of the belt. Also, the rotating means may rotate the housing 50 with a gear train rotated by the driving motor. In this case, a driving gear is connected with the driving motor, and a driven gear is formed in the outer wall of the housing 50. In case the driving gear is distant from the driven gear, an idler may be provided between the driving gear and the driven gear. Also, another gear driving method will be described with reference to the second embodiment of the present invention.

Figure 5A:
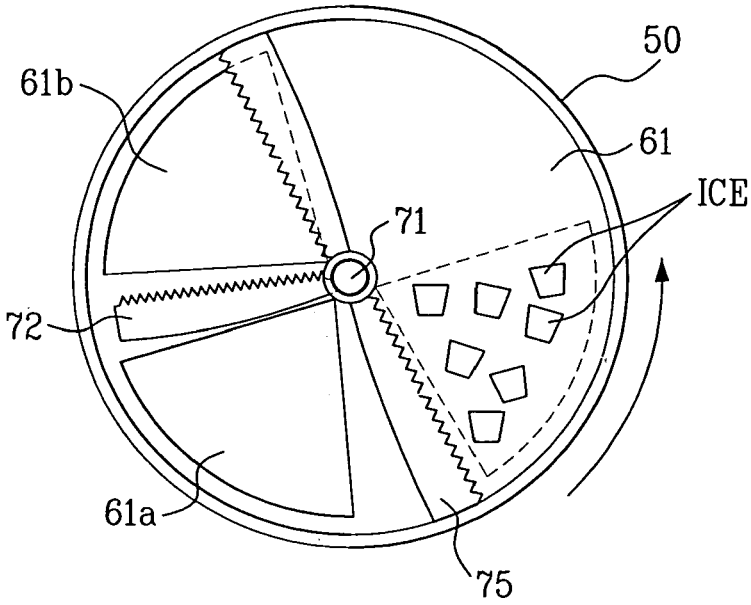
FIG. 5A and FIG. 5B illustrate process steps of discharging uncrushed ice from an ice bank of an ice-making device according to the first embodiment of the present invention.
Figure 5B:
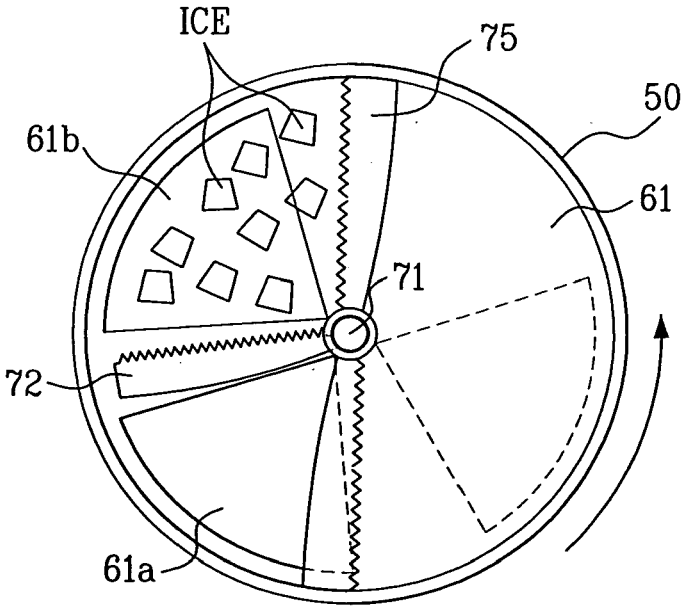
Figure 6A:
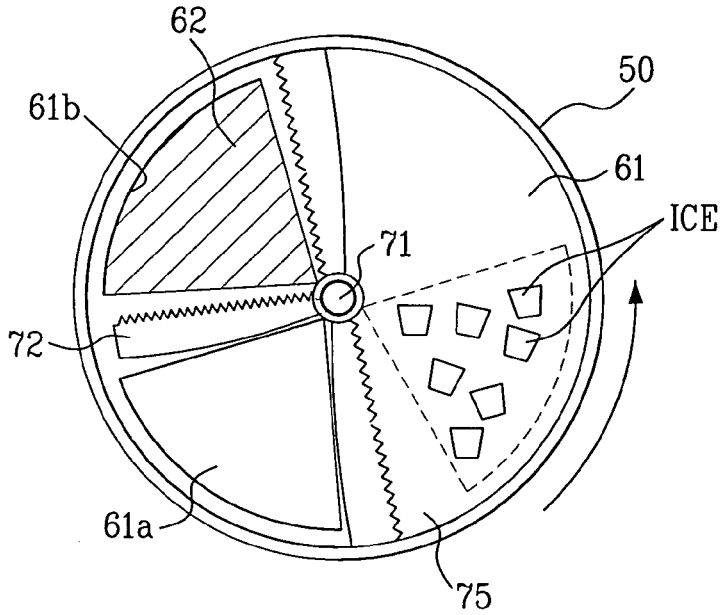
FIG. 6A and FIG. 6B illustrate process steps of discharging crushed ice from an ice bank of an ice-making device according to the first embodiment of the present invention.
Figure 6B:
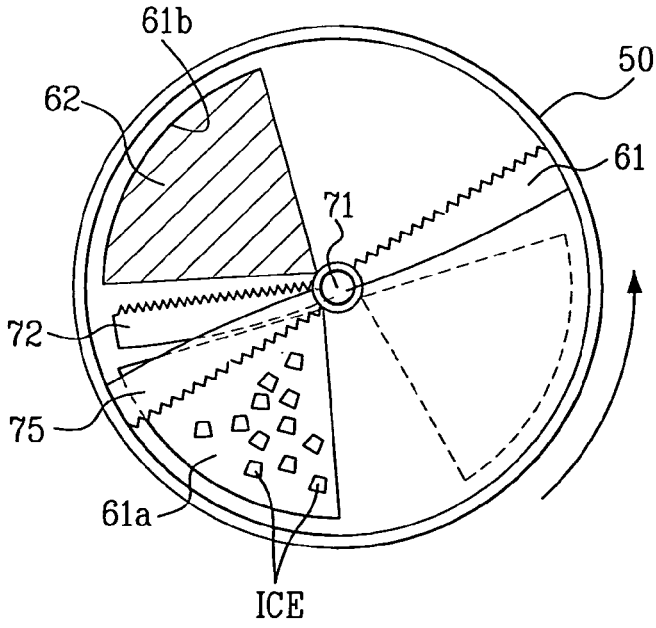

An operation of the ice bank of the ice-making device according to the first embodiment of the present invention will be described with reference to FIG. 5 and FIG. 6. FIG. 5A and FIG. 5B illustrate the process steps of discharging the uncrushed ice, and FIG. 6A and FIG. 6B illustrates the process steps of discharging the crushed ice.

Hereinafter, the process steps for discharging the uncrushed ice will be described with reference to FIG. 5A and FIG. 5B. First, the ice made in the icemaker is stored in the upper part of the fixed plate 73, and then the stored ice is dropped on the base plate 61 through the ice-moving hole 73*a* of the fixed plate by the sliding prevention means 52 of the housing 50, the separating means 74 of the fixed part, and the rotating arm 76. In FIG. 5A and FIG. 5B, a spotted line is the portion of forming the ice-moving hole 73*a* of the fixed plate. Then, the dropped ice is rotated in the clockwise direction by the rotating cutter 75, and then is discharged to the external through the first hole 61*b* provided in the base plate.

Hereinafter, the process steps for discharging the crushed ice will be described with reference to FIG. 6A and FIG. 6B. The ice made in the icemaker is stored in the upper part of the fixed plate 73, and then is dropped on the base plate 61 through the ice-moving hole 73*a* of the fixed plate. At this time, the first hole 61*b* is covered with the damper 62. In FIG. 6A and FIG. 6B, a spotted line is the portion of forming the ice-moving hole 73*a* of the fixed plate. Then, the dropped ice is rotated and moved by the rotating cutter 75, and the ice is crushed at the portion where the rotating cutter passes by the fixed cutters 72*a* and 72*b*. The crushed ice is discharged to the external through the second hole 61*a* provided in the base plate.

Next, an ice bank of an ice-making device for a refrigerator according to the second embodiment of the present invention will be described with reference to FIG. 7 to FIG. 10. At this time, the explanation for the same structure as that according to the first embodiment of the present invention will be omitted.

The ice bank of the ice-making device according to the second embodiment of the present invention includes a housing 500, an ice discharger 600, a crusher 700, and rotating means 800. At this time, the housing 500 for storing ice made in an icemaker (not shown) is provided rotatably, and the ice discharger 600 provides an outlet through which the ice is discharged to the external. Also, the crusher 700 is provided in the inside of the housing 500, and the rotating means 800 is provided to rotate the housing 500. In this state, the housing 500 has an open top 510. Also, when discharging the stored ice to the external, the housing 500 applies the power to the stored ice at a rotation direction, so that the ice is rotated in the housing 500 at the same direction.

In the ice bank according to the second embodiment of the present invention, the housing 500 is formed of a cylindrical shape having sliding prevention means. The sliding prevention means are formed of ribs 520 provided on an upper part of an inner wall of the housing 500 in a longitudinal direction at up and down sides, so that an inner surface of the housing 500 is divided into sections.

The ice discharger 600 is fixed to the bottom of the housing 500. Also, the ice discharger 600 is formed of a round-shaped base plate 610, and the base plate 610 includes a hole 611 having a predetermined size to discharge the ice passing through the crusher 700. Preferably, the crusher 700 includes a fixed part 710 and a rotating part 720. At this time, the fixed part 710 provided in the inside of the housing 500 is not rotated. Also, the rotating part 720 is rotated for being synchronized with the housing 500 so that the rotating part 720 applies rotation power to the stored ice. Thus, the ice is rotated and guided to the ice discharger 600. At this time, in case a user selects a mode for crushing the ice, the rotating part 720 crushes the ice with the fixed part 710, and guides the crushed ice to the ice discharger 600.

In more detail, the fixed part 710 is provided with a fixed rod 711 and at least one fixed crushing means 712. At this time, the fixed rod 711 having a lower end connected with the ice discharger 600 is provided in the inside of the housing 500 at an axis direction. Also, the fixed crushing means 712 has one end connected with the fixed rod 711 so as to crush the ice with the rotating part 720.

Also, the fixed part 710 further includes guiding means for guiding the stored ice to the fixed crushing means 712 as the housing 500 rotates during discharging the stored ice. At this time, the guiding means is provided with a first fixed plate 713*a* and separating means 714, the round-shaped first fixed plate 713*a* provided between the open top 510 of the housing 500 and the fixed crushing means 712, and for passing the stored ice therethrough. Also, in case the ice pieces are stuck and fixed, the separating means 714 applies power to the ice pieces being rotated with the housing 500, thereby separating the ice pieces to have the size suitable for passing through the fixed plate.

The first fixed plate 713*a* has a first ice-moving hole not to be corresponding to the hole 611 of the ice discharger 600, so that it is possible to prevent the ice from dropping on the hole 611 of the ice discharger 600 directly. That is, the first ice-moving hole is used as a passage for the ice. In the second embodiment of the present invention, the first ice-moving hole is formed by cutting one portion of the first fixed plate 713 in a fan shape, whereby the ice is dropped on an opposite side of the hole 611 of the ice discharger 600 to the standard fixed rod 711.

At this time, the first fixed plate divides an inside space of the housing 500 into lower and upper parts. That is, the ice made in the icemaker is firstly stored in a space formed by the housing and the first fixed plate. Then, if the user wants the ice, the housing 500 rotates, whereby the stored ice is rotated and moved. Then, the ice is dropped on the lower part of the housing 500 through the passage formed by the first fixed plate 713*a*. In this process, if the ice pieces are stuck and fixed, the separating means 714 is used to separate the ice pieces. At this time, the separating means 714 is formed by curving at least one portion of the fixed rod 711 toward the inner wall of the housing 50 in a "ㄷ" or "S" shape.

The fixed crushing means 712 includes a fixed cutter 712*a* having one end connected with the fixed rod, the other end extending toward the inner wall of the housing 500 to avoid the interference with the rotating part, and at least one side formed as a cutting edge. The fixed cutter 712*a* is provided at one side above the hole 611 of the ice discharger 600. Also, the cutting edge is provided at an opposite side to the hole of the ice discharger, and an end portion of the fixed cutter 712*a* is curved to a direction of forming the cutting edge.

In the second embodiment of the present invention, if the rotating part is rotated in a clockwise direction of forming the fixed cutter, the crushed ice is discharged. Meanwhile, if the rotating part is rotated in a counter-clockwise direction, the uncrushed ice is discharged. That is, it is required to provide the rotating part being rotated both in the clockwise and counter-clockwise directions. In case the two fixed cutters 712*a* and 712*b* are provided, it is preferable to provide the fixed cutters 712*a* and 712*b* for being in parallel at fixed intervals.

Also, a second fixed plate 713*b* is provided at a lower part of the fixed cutters 712*a* and 712*b* so as to form a second ice-moving hole used as a passage for the dropped ice, the second ice-moving hole formed by cutting one portion of the second fixed plate 713*b* in a fan shape. Furthermore, a third fixed plate 713*c* is provided at a lower part of the second fixed plate 713*b*. The third fixed plate 713*c* has a fan-shaped hole above the hole 611 of the ice discharger 600, and the cut ice piece passes through the fan-shaped hole. At this time, the third fixed plate 713*c* is fixed on the base plate 610. For this, one or more projections 612 are provided on an upper surface of the base plate 610, and insertion holes (not shown) are provided on a lower surface of the third fixed plate 713*c* for being corresponding to the projections 612.

Meanwhile, the rotating part 720 includes rotation crushing means provided in the inner wall of the housing 500. At this time, the rotation crushing means includes a hollow-shaped supporter 721 fixed to the inner wall of the housing 500, and at least one rotating cutter 725 supported by the inner wall of the supporter 721 so as to avoid the interference with the fixed cutter. In more detail, both ends of the rotating cutter are supported with the inner wall of the supporter, and the rotating cutter has at least one side formed as a cutting edge.

In the second embodiment of the present invention, the rotating cutter is provided in a diameter direction crossing the inside of the supporter, and a central part 725*c* of the rotating cutter is rotatably connected with the fixed rod. The cutting edges of the rotating cutter 725, provided on opposite sides of the central part 725*c,* are formed in the clockwise direction. In case the two or more rotating cutters are provided, it is preferable to position the rotating cutters at fixed intervals. In this state, the rotating cutters may be in parallel, or at a predetermined angle.

Furthermore, the rotating part includes at least one rotating arm 726 provided at a direction crossing the upper part of the first fixed plate713*a,* and synchronized with the housing 500 for being rotated. At this time, the rotating arm 726 is provided to cross the inner upper space of the housing 500 in the inner wall of the hollow-shaped supporter 721.

The rotating means 800 includes a driving motor 810 provided at the side of the housing 500, a driving gear 820 rotated by the driving motor 810, a first driven gear 830 rotated by the driving motor 810, a second driven gear 832 connected with and rotated on a common axis 831 with the first driven gear 830, and a ring gear 840 rotated by the second driven gear 832.

The common axis 831 of the first and second driven gears 830 and 832 is provided to rotatably pass through a point being slightly apart from a central point between the base plate 610 and the third fixed plate 713*c* in a radial direction. Preferably, connecting member 833 is provided in a central portion of the axis for connecting the axes of the first and second driven gears. Also, the ring gear 840 is provided at an upper part of the third fixed plate 713*c*. In this case, the ring gear 840 is formed by forming a gear in the inner circumferential surface of the ring for being mated with the second driven gear 832. The outer circumferential surface of the ring gear 840 is fixed to the housing 50. For this, ring-shaped fixing member 850 is provided between the outer circumferential surface of the ring gear and the lower inner circumferential surface of the housing. Also, an idler 860 may be provided between the driving gear 820 and the first driven gear 830.

In the preferred embodiment of the present invention, a circular-shaped projecting guide is formed on the edge of the third fixed plate 713*c,* and the lower end of the housing 500 is positioned in the inside of the circular-shaped projecting guide. In another way, a bearing may be provided between the lower inner circumferential surface of the housing 500 and the outer circumferential surface of the base plate, or between the lower inner circumferential surface of the housing 500 and the outer circumferential surface of the third fixed plate, whereby the housing is rotated freely.

Figure 9A:
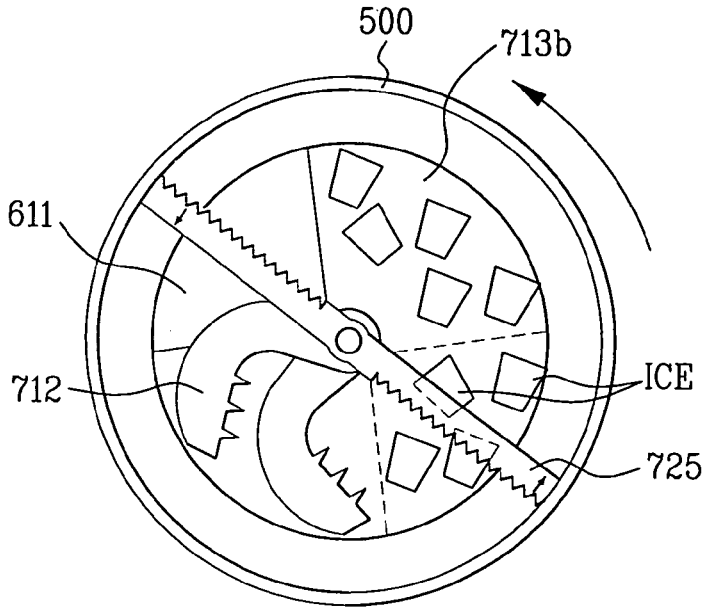
FIG. 9A and FIG. 9B illustrate process steps of discharging uncrushed ice from an ice bank according to the second embodiment of the present invention.
Figure 9B:
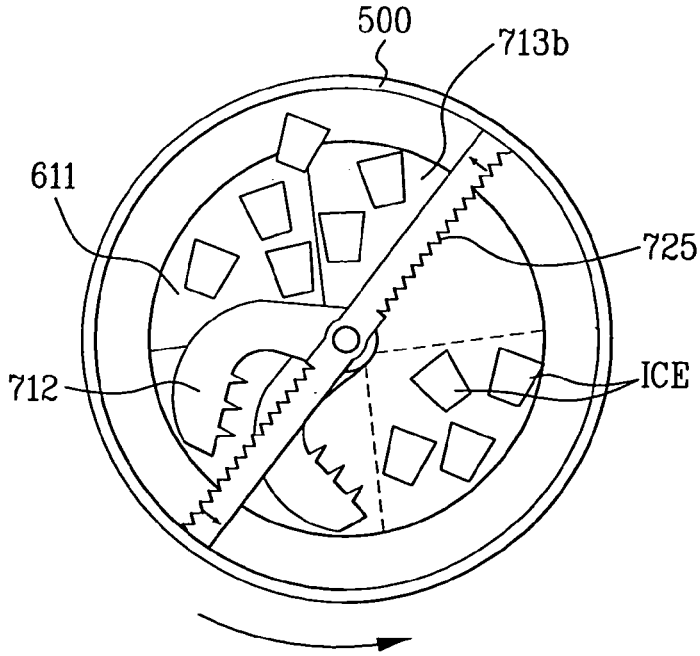
Figure 10A:
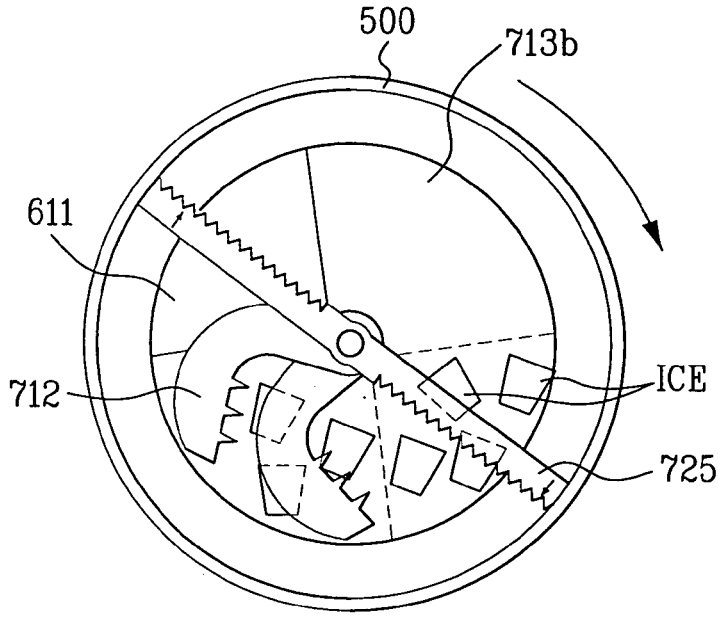
FIG. 10A and FIG. 10B illustrate process steps of discharging crushed ice from an ice bank according to the second embodiment of the present invention.
Figure 10B:
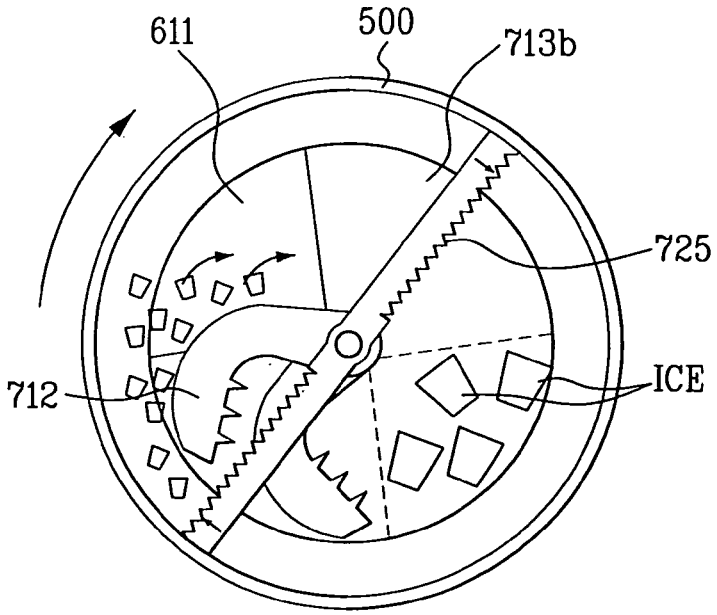

An operation of the ice bank of the ice-making device according to the second embodiment of the present invention will be described with reference to FIG. 9 and FIG. 10. FIG. 9A and FIG. 9B illustrate the process steps of discharging the uncrushed ice, and FIG. 10A and FIG. 10B illustrate the process steps of discharging the crushed ice.

Hereinafter, the process steps of discharging the uncrushed ice will be described with reference to FIG. 9A and FIG. 9B. First, the ice made in the icemaker is stored in the upper part of the first fixed plate, and then the ice is dropped on the second fixed plate 713*b* through the ice-moving hole of the first fixed plate by the rotation of the housing 500, the rotating arm 726 and the separating means 714 of the fixed part. In FIG. 9A and FIG. 9B, a spotted line is the portion of forming the ice moving-hole of the first fixed plate 713*a.*

At this time, as the rotating cutter 725 is rotated at the direction forming no cutting edge (counter-clockwise direction), the dropped ice is rotated and moved, whereby the moved ice passes by the second fixed plate 713*b* and the third fixed plate 713*c.* Then, the ice is discharged to the external through the hole 611 of the base plate.

Hereinafter, the process steps of discharging the crushed ice will be described with reference to FIG. 10A and FIG. 10B. The ice made in the icemaker is stored in the upper part of the first fixed plate, and then the ice is dropped on the second fixed plate 713*b* through the ice-moving hole of the first fixed plate 713*a* by the rotation of the housing 500 and the separating means 714 of the fixed part. In FIG. 10A and FIG. 10B, a spotted line is a portion of forming the ice-moving hole of the first fixed plate 713*a.*

At this time, as the rotating cutter 725 is rotated at the direction of forming the cutting edge (clockwise direction), the dropped ice is rotated and moved. In this case, the ice is crushed at the portion where the rotating cutter 725 passes by the fixed cutters 712*a* and 712*b.* After that, the crushed ice is discharged to the external through the hole 611 of the base plate after passing by the second fixed plate 713*b* and the third fixed plate 713*c.*

As mentioned above, the ice bank of the ice-making device for the refrigerator according to the present invention has the following advantages.

In the ice bank of the ice-making device for the refrigerator according to the present invention, as the housing rotates, the sliding prevention means applies the power to the stored ice. Thus, in case the ice pieces stored in the inside of the housing are stuck and fixed, it is possible to separate and discharge the ice pieces smoothly.

Also, it is possible to prevent the load on the driving motor for separating the ice pieces being stuck and fixed, thereby preventing the driving motor from being damaged.

In addition, the user selects the mode for the uncrushed ice or the crushed ice.

Furthermore, it is possible to minimize the occupying space of the ice bank, and to simplify the structure thereof.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An ice bank of an ice-making device comprising:

a rotatably mounted housing for storing ice made in an icemaker, and to move the stored ice in a predetermined direction;

an ice discharger having at least one hole through which the ice is discharged to the exterior of the housing;

a crusher provided inside of the housing, the crusher crushing the ice before discharging the ice from the hole according to a user'selection;

a separator provided in the housing, the separator separating ice pieces stuck together by applying a force to the ice pieces in the housing, before the ice pieces are crushed by the crusher; and a rotating device for rotating the housing.

2. The ice bank as claimed in claim 1, wherein the housing includes:

an open top through which the ice made in an icemaker enters; and a sliding preventor configured to apply a force to the ice stored in the housing during rotation of the housing for rotating the stored ice in the housing.

3. The ice bank as claimed in claim 2, wherein the sliding preventor comprises a plurality of projections provided on an upper inner wall of the housing.

4. The ice bank as claimed in claim 1, wherein the ice discharger comprises a base plate, the base plate provided as a bottom of the housing and is not rotatable.

5. The ice bank as claimed in claim 4, wherein the ice discharger further includes an uncrushed ice hole, through which uncrushed ice is discharged to the exterior, the uncrushed ice hole being provided in the base plate.

6. The ice bank as claimed in claim 5, wherein the ice discharger further includes a damper to selectively open the uncrushed ice hole.

7. The ice bank as claimed in claim 1, wherein the crusher includes:

a fixed part provided in the housing and that is not rotated; and a rotating part rotatably provided in the housing and selectively crushing the ice together with the fixed part.

8. The ice bank as claimed in claim 7, wherein the fixed part includes:

a fixed rod provided in the housing; and at least one fixed crushing member having one end connected with the fixed rod to crush the ice together with the rotating part.

9. The ice bank as claimed in claim 8, wherein the fixed part further includes a guide member that is connected with the fixed rod so as to guide the stored ice to the fixed crushing member as the housing rotates.

10. The ice bank as claimed in claim 9, wherein the guide member includes a fixed plate through which the stored ice passes, the fixed plate being provided between the open top of the housing and the fixed crushing member.

11. The ice bank as claimed in claim 10, wherein the fixed plate includes an ice passage hole through which the stored ice passes, the ice-passage hole being spaced circumferentially with respect to the hole of the ice discharger so as to prevent the ice from directly dropping through the hole of the ice discharger.

12. The ice bank as claimed in claim 11, wherein the separator is provided in the upper side of the fixed plate, the separator separating the ice pieces into ice have having a size suitable for passing through the ice passage hole of the fixed plate.

13. The ice bank as claimed in claim 12, wherein the separator includes at least one arm having one end connected with the fixed rod, and the other end extending toward the inner wall of the housing.

14. The ice bank as claimed in claim 12, wherein the separator includes at least one curved part extending from the fixed rod toward the inner wall of the housing.

15. The ice bank as claimed in claim 8, wherein the fixed crushing member includes a fixed cutter having one end connected with the fixed rod, the other end extending toward the inner wall of the housing, and a cutting edge.

16. The ice bank as claimed in claim 15, wherein the fixed cutter is provided above the ice discharger and crushes the ice with the rotating part the ice approaches the hole of the ice discharger by rotation of the rotating part when a user selects crushed ice.

17. The ice bank as claimed in claim 15, wherein, the ice discharger includes two holes for discharging the ice, the fixed cutter is provided between the holes of the ice discharger.

18. The ice bank as claimed in claim 8, wherein the rotating part includes a rotatable crushing member fixed to and supported by an inner wall of the housing.

19. The ice bank as claimed in claim 18, wherein the rotatable crushing member includes at least one rotating cutter each having a cutting edge.

20. The ice bank as claimed in claim 19, wherein the rotatable crushing member further includes a hollow-shaped support fixed to the inner wall of the housing and supporting the rotating cutter.

21. The ice bank as claimed in claim 8, wherein the rotating part includes a rotatable crushing member means having one end fixed to the inner wall of the housing, and the other end rotatably connected with the fixed rod.

22. The ice bank as claimed in claim 21, wherein the rotatable crushing member includes at least one rotating cutter having a cutting edge.

23. The ice bank as claimed in claim 10, wherein the rotating part includes at least one rotating arm extending in a direction to cross an upper space of the fixed plate, the rotating arm being rotated by the housing.

24. The ice bank as claimed in claim 1, wherein the rotating device includes a belt driven by a driving motor.

25. The ice bank as claimed in claim 1, wherein the rotating device includes a gear train driven by a driving motor.

26. The ice bank as claimed in claim 25, wherein the gear train includes:

a driving gear connected with the driving motor; and a driven gear provided on an outer circumferential surface of the housing, and being rotated by the driving gear.

27. The ice bank as claimed in claim 25, wherein the gear train includes:

a driving gear connected with the driving motor;

a ring gear having an outer circumferential surface fixed to the inner wall of the housing, and an inner circumferential surface having an internal gear thereon; and a shaft gear positioned to extend into the ice discharger and to be rotated by the driving gear, and the shaft gear mating with the ring gear to avoid interference with the crusher.

28. The ice bank as claimed in claim 1, wherein, the ice bank is provided in a refrigerator, the ice bank is provided in the an inner wall of a door of a freezer of the refrigerator.

* * * * *